US006887322B2

(12) United States Patent
Smith et al.

(10) Patent No.: US 6,887,322 B2
(45) Date of Patent: May 3, 2005

(54) HIGH PRESSURE CYLINDERS INCLUDING BACKING STEEL WITH TOOL STEEL LINING

(75) Inventors: Donald W. Smith, Forest, VA (US); Calvin D. Lundeen, Lynchburg, VA (US)

(73) Assignee: Wexco Corporation, Lynchburg, VA (US)

( * ) Notice: Subject to any disclaimer, the term of this patent is extended or adjusted under 35 U.S.C. 154(b) by 0 days.

(21) Appl. No.: 10/119,057

(22) Filed: Apr. 9, 2002

(65) Prior Publication Data

US 2002/0174919 A1 Nov. 28, 2002

Related U.S. Application Data

(60) Provisional application No. 60/282,624, filed on Apr. 9, 2001.

(51) Int. Cl.[7] ..... C21D 9/08; C21D 9/14; C21D 6/00; B23P 11/00; B23P 15/00

(52) U.S. Cl. ..... 148/516; 148/519; 148/527; 148/529; 148/579; 148/590; 148/592; 29/888.06

(58) Field of Search ..... 428/683; 148/516, 148/519, 521, 527, 529, 579, 590, 592; 29/488.06; 427/383.1

(56) References Cited

U.S. PATENT DOCUMENTS

| | | | | |
|---|---|---|---|---|
| 2,647,847 A | | 8/1953 | Black et al. | |
| 3,579,805 A | | 5/1971 | Kast | |
| 3,658,515 A | | 4/1972 | Saltzman | |
| 3,710,434 A | * | 1/1973 | Daniels et al. | 228/106 |
| 3,753,704 A | | 8/1973 | Manilla et al. | |
| 3,836,341 A | | 9/1974 | Saltzman et al. | |
| 3,884,730 A | * | 5/1975 | Hehl | 148/12.4 |
| 4,016,008 A | | 4/1977 | Forbes Jones et al. | |
| 4,103,800 A | | 8/1978 | Lomax et al. | |
| 4,141,761 A | | 2/1979 | Abraham et al. | |

(Continued)

FOREIGN PATENT DOCUMENTS

| | | | |
|---|---|---|---|
| CA | 1184571 | | 3/1985 |
| EP | 0052092 | | 9/1984 |
| EP | 0410452 | A2 | 1/1991 |
| EP | 0453345 | A1 | 4/1991 |
| EP | 0652101 | A1 | 10/1994 |
| JP | 61143547 | | 7/1986 |
| JP | 07-332153 | * | 12/1995 |
| JP | 63202420 | | 8/1998 |

OTHER PUBLICATIONS

WEXCO Tool Steel Cylinders, website download (two pages), visited Jun. 2004.*

"High–Strength Structural and High–Strength Low–Alloy Steels", *Metals Handbbok*, vol. 1, 10$^{th}$ Edition, Properties & Selections: Irons and Steels, pp 389–423, no date.

"HIP Techniques for Barrels and Screws", pp 12–15 (REILOY product specification), no date.

"More Efficient Processing of Thermoplastic Materials Is Our Objective", (THEYSOHN product specification, no date.

"The Experts in Wear Resistance", (REILOY product specification), no date.

*Primary Examiner*—Michael La Villa
(74) *Attorney, Agent, or Firm*—Alan G. Towner, Esq.; Pietragallo, Bosick & Gordon

(57) ABSTRACT

High pressure cylinders comprising backing steel cylinders and tool steel liners are disclosed. An annealed tool steel liner is inserted into the backing steel cylinder, followed by heat treating to harden the tool steel liner. The tool steel liner may be provided as a single continuous tube, thereby avoiding problems associated with segmented liners. The high-pressure cylinders are suitable for use as plastic and rubber extruders injection molding cylinders and the like.

47 Claims, 1 Drawing Sheet

U.S. PATENT DOCUMENTS 4,142,922 A 3/1979 Abraham et al.
4,162,758 A * 7/1979 Mikarai ..... 228/131
4,367,838 A * 1/1983 Yoshida ..... 228/114.5
4,430,389 A 2/1984 Otani
4,497,673 A 2/1985 Esser
4,519,713 A 5/1985 Godsey et al.
4,596,282 A * 6/1986 Maddy et al. ..... 164/76.1
4,679,294 A * 7/1987 Lomax et al. ..... 29/460
4,808,486 A 2/1989 Yamamoto et al.
4,863,661 A 9/1989 Maddy
5,017,335 A 5/1991 Bramfitt et al.
5,019,459 A 5/1991 Chou et al.
5,093,209 A 3/1992 Kroisenbrunner
5,160,690 A 11/1992 Cox, Jr. et al.
5,185,162 A 2/1993 Chou
5,565,277 A 10/1996 Cox, Jr. et al.
5,842,109 A * 11/1998 Akpan et al. ..... 419/38
5,906,691 A 5/1999 Burnett et al.
5,935,351 A 8/1999 Sherman et al.
6,060,180 A * 5/2000 Ishitsuka et al. ..... 428/683
6,309,762 B1 * 10/2001 Speckert ..... 428/683

* cited by examiner

HIGH PRESSURE CYLINDERS INCLUDING BACKING STEEL WITH TOOL STEEL LINING

CROSS REFERENCE TO RELATED APPLICATION

This application claims the benefit of U.S. Provisional Application Ser. No. 60/282,624 filed Apr. 9, 2001.

FIELD OF THE INVENTION

The present invention relates to high pressure cylinders, and more particularly relates to cylinders including a backing steel cylinder and a tool steel lining which are useful in applications such as plastic and rubber extruders, injection molding equipment, blow molding equipment, and material transfer lines.

BACKGROUND INFORMATION

Conventional steel cylinders for use in plastic or rubber extruders and injection molding machinery comprise a series of relatively short tube segments made of tool steel assembled inside a larger tube known as a backing tube or backing material. Short tube steel segments are used because of heat-treating problems associated with longer thin-walled tubing. Typically, thin-walled tool steel tubes warp during the heat-treating process and crack when inserted into the straight bore of the backing tube for shrink fitting purposes. Manufacturers currently overcome this problem by keeping the length of the tool steel segments short.

Segmented tool steel liners have several inherent problems. While manufacturers claim that the segmented liners appear to be essentially seamless as a result of a honing process, the cracks between the segments are still there, even if they are initially microscopically small. During the operating life of the cylinder, the constant mechanical flexing caused by thermal and mechanical forces may cause the segments to separate slightly. When such conventional cylinders are used for plastic extrusion, colored plastic residue may get trapped in the cracks and contaminate a new colored plastic that is being processed.

Furthermore, cracks between the segments open due to normal wear on the tool steel liner bore as a result of processing certain plastic resins, especially highly abrasive plastics. Corrosiveness of the resin material being processed further deteriorates cylinder performance by attacking the unprotected backing material in the areas of the cracks.

While tool steel segments in conventional designs are typically held in place by means of an interference fit, typical manufacturing tolerances on the outside diameter of the tool steel segment and the corresponding inside diameter of the backing tube can result in variations in the interference fit. Thus, while one of the segments may held in place by be a true and severe shrink fit, another may be merely a line-on-line fit that generates very little or no real holding power. The short length of such a tool steel tube segment would provide no appreciable anti-rotational resistance.

The present invention has been developed in view of the foregoing, and to address other deficiencies of the prior art.

SUMMARY OF THE INVENTION

An embodiment of the present invention utilizes a full-length, one-piece tool steel cylindrical bar or liner tube that is shrunk fit into, e.g., a micro-alloy or austenitic stainless steel backing tube, thus providing superior resistance to axial or rotational movement caused by operating conditions.

After the tool steel liner is inserted into the tight bore of the steel backing tube, the assembly is subjected to a heat treat process that strengthens the backing material e.g., through grain size refinement and carbide formation while, at the same time, strengthening the tool steel liner by forming, e.g., tempered martensite. Heat treating the pre-assembled full-length tubes together, rather than individually and separately, causes the effect of slow cooling of the tool steel liner due to the heat storage provided by the backing tube surrounding the liner. This slow cooling has a similar effect on the tool steel liner as marquenching.

An embodiment of the invention includes the single-event heat treatment process of any combination of steel tubing that retains desired ductility on the backing tube while hardening the internal liner tube to a desired hardness for maximum wear resistance. Inserting the tool steel liner into a backing tube and subsequently heat treating both simultaneously as an assembly provides mechanical strength and support to prevent heat and stress induced warping of the thin-walled tool steel liner, thus resulting in less post-heat-treatment machining to finish the cylinder assembly to industry standards.

In one embodiment, the present invention provides for the use of microalloy steel, such as JP38, as a backing material for tool steel inserts. The present method may utilize such backing steels in combination with tool steel liners such as AISI D2, CPM10V and CPM15V tool steels. By using the appropriate backing material, tool steel liners can be inserted into the backing material in the annealed condition and subsequently heat-treated in-situ. This makes it possible to have a continuous tool steel liner while maintaining straightness requirements. The microalloy backing material makes it possible to use a variety of heat treatment procedures without unduly affecting the straightness of the steel. The cylinder can be continuously cooled to achieve tool steel hardness, e.g., of HRC 60 or higher.

An aspect of the present invention is to provide a method of making a high-pressure cylinder. The method includes the steps of inserting an annealed tool steel liner into a backing steel cylinder, and heat treating the tool steel insert and backing steel cylinder.

Another aspect of the present invention is to provide a high-pressure cylinder comprising a backing steel cylinder and a continuous tool steel insert lining.

These and other aspect of the present invention will be more apparent from the following description.

DETAILED DESCRIPTION

Figure 1:
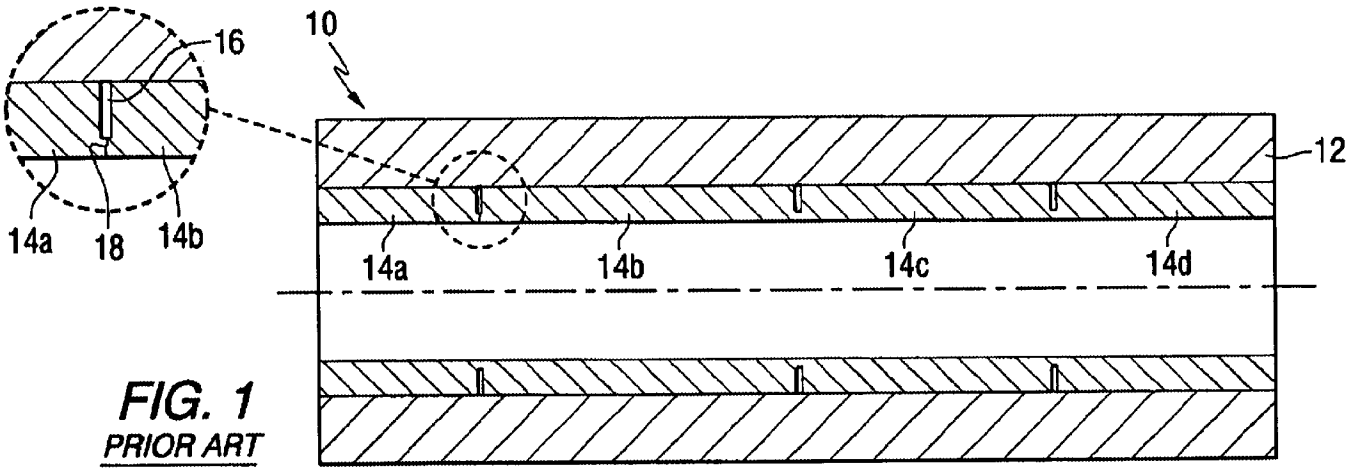
FIG. 1 PRIOR ART
FIG. 1 is a longitudinal section view of a conventional high-pressure cylinder comprising a backing steel cylinder and a steel liner comprising multiple segments.

FIG. 1 is a longitudinal section view illustrating a conventional high-pressure cylinder 10. The cylinder 10 includes a backing steel cylinder 12 and a multi-segment steel liner 14*a–d*. As shown most clearly in the enlarged portion of FIG. 1, adjacent sections of the steel liner, e.g., 14*a* and 14*b* are separated by a narrow gap 16. The size of the gap 16 may be reduced at the inner surface of the sections 14*a* and 14*b* by methods such as honing. Although these efforts can reduce the size of the gap 16, a small crack 18 is present and will appear on the interior surface of the liner after the honing process or after the cylinder 10 has been used during normal extrusion or injection molding operations.

Figure 2:
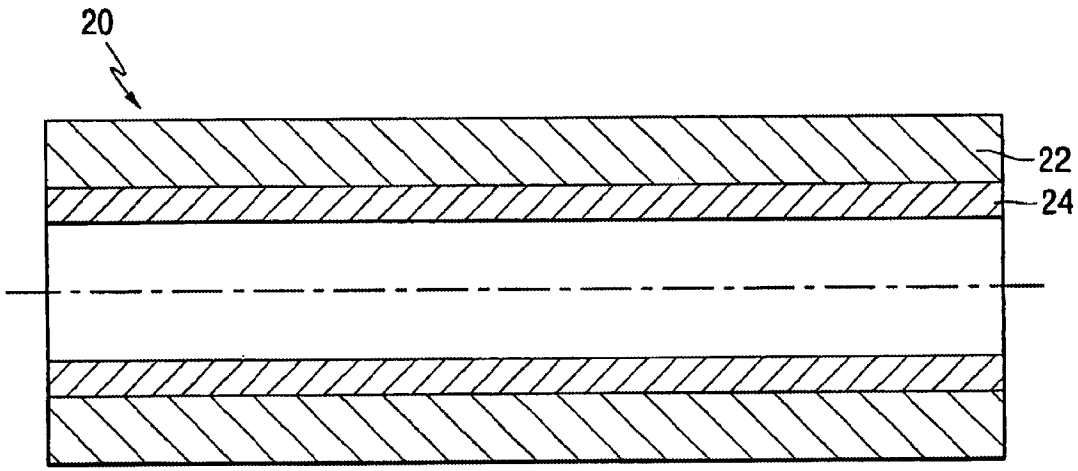
FIG. 2 is a longitudinal section view of a high-pressure cylinder comprising a backing steel cylinder and a continuous tool steel liner in accordance with an embodiment of the present invention.

FIG. 2 is a longitudinal section view illustrating a high-pressure cylinder 20 in accordance with an embodiment of the present invention. The cylinder 20 includes a backing steel cylinder 22 and a tool steel liner 24. As more fully described below, the backing steel cylinder 22 may comprise microalloy steel, high strength low alloy steel, low carbon steel and/or austenitic stainless steel. The liner 24 comprises tool steel and is preferably made of a single, continuous member.

Conventionally, manufacturers of tool steel liners insert multiple segments of heat-treated tool steel into a backing material (usually 4140), as illustrated in FIG. 1. In contrast, the present process allows the continuous seamless liner to be inserted, as illustrated in FIG. 2. Thus, a seam is avoided. By using a microalloy or other similar backing material, the tool steel can be heat-treated in-situ. The in-situ heat treatment process maintains straightness in the tool steel insert. In traditional heat treatment processes on thin-wall tool steel straightness is not maintained.

In accordance with the present invention, tool steel in an annealed condition is inserted into a backing steel material, such as microalloy steel. As used herein, the term "annealed" is used broadly to describe the condition of the tool steel prior to a heat-treating step which hardens the steel to its final hardness. Thus, the annealed tool steel inserts may be in a normalized condition or any other condition which allows machining of the tool steel prior to the final heat treatment.

The backing steel is used to support or strengthen the integrity of the cylinder. Suitable backing steels for this process are steels that can be strengthened without forming a high percentage of martensite. Suitable backing steels include microalloy steels, austenitic stainless steels, low-carbon steels and high strength low-alloy steels. Some examples of suitable backing steels are listed in the ASM Metals Handbook, Tenth Edition.

High strength low alloy steels have a carbon content of less than 0.26 weight percent. Their combined alloying concentrations may reach as high at 10 weight percent.

Microalloys steels contain other alloying elements such as copper, vanadium, nickel and molybdenum. There are three classes of microalloy steels which may be separated by carbon content, those with less than 0.26 weight percent, microalloy steels with carbon content up to 0.5 weight percent, and class III microalloy steels which can be strengthened by forming martensite. Their combined alloying concentrations may reach as high as 10 weight percent. Microalloys provide higher resistance to corrosion as well as elevated strengths in comparison with plain carbon steels. For example, a type of microalloy steel is JP 38, which has carbon content up to 0.40 weight percent. Low carbon microalloy steels are sometimes included as a subset of high strength low alloy steels.

Austenitic stainless steel is characterized by its austenitic crystal structure. Developed with at least 10.0 weight percent chromium, this stainless steel resists oxidation and makes the material passive or corrosion resistant. Commonly used types include 304 and 316 stainless steels.

Low carbon steels are classified as low carbon because their carbon content is less than 0.26 weight percent. They are unresponsive to normal heat treatments but are strengthened by cold work. These alloys are relatively soft and weak but provide outstanding ductility and toughness. Common low carbon steels include 1020 and 1026.

Table 1 lists some backing steel compositions that may be used in accordance with the present invention.

In accordance with the present invention, a tool steel liner is inserted into the backing steel cylinder. Tool steel is any steel that is typically formed into tools for cutting or otherwise shaping a material. These steels are characterized by high strength in the heat treated condition and low distortion. Typically, these steels have carbon content in excess of 0.8 weight percent. However, some tool steel alloys have lower carbon content.

Tool steels are characterized by the processing method needed to produce tooling and by special characteristics. Tool steel types include high-speed steels (M, T Series), hot work steels (H Series), high carbon cold work steels (D Series), air-hardening cold worked steels (A Series), oil-hardening steels (O Series), shock-resisting steels (S Series), water-hardening steels (W Series), and special purpose tool steels, such as low-alloy or low-carbon tool steels.

Some examples of suitable tool steels are listed in Table 2.

TABLE 1

Backing Steel Compositions

| Type | Example | C | Mn | V | S | Si | N | P | Cr | Ni | Mo | Cu | Iron |
|---|---|---|---|---|---|---|---|---|---|---|---|---|---|
| Microalloy Class I | 965X | <0.26 | 0.35–1.60 | <0.12 | 0–0.03 | 0.10–0.30 | <0.015 | 0–0.035 | 0–1.2 | 0–0.25 | 0–0.06 | 0–0.035 | Bal. |
| Microalloy Class II | JP 38 | 0.36–0.40 | 1.30–1.50 | 0.080–0.120 | 0–0.045 | 0.50–0.70 | 0.012–0.018 | 0–0.035 | 0–0.2 | 0–0.25 | 0–0.06 | 0–0.035 | Bal. |
| High Strength Low Alloy Steel | 945X | <0.26 | 0.35–1.60 | <0.12 | 0–0.03 | 0.10–0.30 | <0.015 | 0–0.035 | 0–1.2 | 0–0.25 | 0–0.06 | 0–0.035 | Bal. |
| Low Carbon Steels | 1020 | 0.18–0.23 | 0.3–0.60 | — | — | — | — | — | — | — | — | — | Bal. |
| | 1026 | 0.22–0.28 | 0.6–0.90 | — | — | — | — | — | — | — | — | — | Bal. |

TABLE 1-continued

| Backing Steel Compositions | | | | | | | | | | | | | |
|---|---|---|---|---|---|---|---|---|---|---|---|---|---|
| Type | Example | C | Mn | V | S | Si | N | P | Cr | Ni | Mo | Cu | Iron |
| Austenetic Stainless Steel | 304 | 0.08 | 1.50 | — | — | 2.00 | — | — | 18.0–21.0 | 8.0–11.0 | — | — | Bal. |
| | 316 | 0.08 | 1.50 | — | — | 2.00 | — | — | 18.0–21.0 | 9.0–12.0 | 2.0–3.0 | — | Bal. |

TABLE 2

| Tool Steel Compositions | | | | | | | | | | | | | |
|---|---|---|---|---|---|---|---|---|---|---|---|---|---|
| Example | C | Mn | Si | Cr | Ni | Mo | W | V | P | S | N | Cu | Fe |
| AISI A11 | 2.00–3.00 | 0.06 Max | 1 Max | 4–8 | 0.20 Max | 0.9–1.5 | 0.013 | 9–11 | 0.035 Max | 0.09 Max | — | 0.070 Max | Bal. |
| AISI D2 | 1.40–1.60 | 0.60 Max | 0.60 Max | 11.00–13.00 | 0.30 Max | 0.70–1.20 | — | 1.10 Max | — | — | — | — | Bal. |
| CPM 10V | 2.00–3.00 | 0.06 Max | 1 Max | 4–8 | 0.20 Max. | 0.9–1.5 | 0.013 | 9–11 | 0.035 Max | 0.09 Max | — | 0.070 Max | Bal. |
| 20CV | 1.9 | 0.3 | 0.3 | 20 | — | 1 | 0.6 | 4 | — | — | — | — | Bal. |
| CSM 420 | 0.15 Max | 1 | 1 | 12–14 | — | — | — | — | 0.04 | 0.03 | — | — | Bal. |

In one embodiment, the tool steel liner is inserted into the backing tube as a solid bar. After the solid bar is inserted into the backing tube, and it is allowed to cool, a bore is machined into the assembly. The solid bar typically has a circular cross section. However, other cross sections such as hexagonal, rectangular or helical may be used. The backing steel cylinder is typically heated to an elevated temperature of at least 300° C. before the solid bar is inserted. It may not be necessary to cool the piece before machining the tool steel, because the tool steel remains in the annealed condition.

In another embodiment, the tool steel liner is inserted in the form of a tube into the backing tube. In this embodiment, the tube typically has a wall thickness of from about 3 to about 30 mm. For example, the tube may have a wall thickness from about 5 to about 10 mm. As a particular example, the tube may have a wall thickness of about 6 mm. The tool steel liner typically has an outer diameter from about 12 to 380 mm. For example, the tool steel liner may have an outer diameter from about 18 to about 90 mm.

The backing steel cylinder may have a wall thickness of at least 20 mm. For example, the backing steel cylinder may have a wall thickness of from about 25 mm to 100 mm. As a particular example, the backing steel cylinder may have a wall thickness of 50 mm. The backing steel cylinder typically has an inner diameter from about 15 to about 380 mm. For example, the backing steel cylinder may have an inner diameter of from about 20 to about 90 mm.

In accordance with an embodiment of the present invention, the tool steel liner has an outer diameter that is greater than or equal to an inner diameter of the backing steel cylinder when the tool steel liner is inserted into the backing steel cylinder. For example, the tool steel liner may have an outer diameter that is from about 0.05 to about 0.2 percent greater than the inner diameter of the backing steel cylinder. As a further example, the tool steel liner may have an outer diameter that is within ±0.1 percent of the inner diameter of the backing steel cylinder.

The tool steel liner preferably has substantially the same length as the backing steel cylinder, i.e., their lengths are within 5 percent of each other. The tool steel liner and the backing steel cylinder typically have lengths of from about 0.25 to about 8 m. For example, the tool steel liner and the backing steel cylinder may have lengths from about 0.6 to about 2 m.

The backing steel cylinder is preferably heated to an elevated temperature before the tool steel liner is inserted. The elevated temperature may range from about 300 to about 520° C. For example, the elevated temperature may range from about 300 to 350° C.

After the annealed tool steel liner has been inserted into the backing steel cylinder, the assembly is heat-treated. Typically, the heat-treating step may be performed at a temperature of from about 1,010 to about 1,250° C. For example, the heat-treating step may be performed at a temperature from about 1,180 to about 1,200° C. In a preferred embodiment, the backing steel cylinder and tool steel liner assembly are rotated around the axis of the cylinder during the heat-treating step.

After the heat-treating step, the assembly may be quenched, i.e., by applying liquid on the outside of the backing steel cylinder. The quenching liquid may be applied until the outside of the backing steel cylinder is reduced to a temperature, e.g., below about 480° C. As a particular example, the assembly may be quenched by spraying water onto the outside of the backing steel cylinder. The spraying may be continued until the outer surface is reduced to a temperature below 480° C. The assembly may be rotated around the axis of the cylinder during the quenching step. After the quenching step, the assembly may be cooled to room temperature by any suitable method such as air cooling.

Upon insertion into the backing steel cylinder, the annealed steel tool liner typically has a hardness of less than 30 HRC, for example less than 25 HRC. After the heat-treating step, the tool steel liner typically has a hardness of greater than 55 HRC, for example greater than 62 HRC.

Upon initial insertion of the tool steel liner into the backing steel cylinder, the backing steel cylinder typically has a hardness of less than HRC 32, for example less than HRC 18. After the heat-treating step, the backing steel cylinder typically has a hardness of greater than HRC 23.

The following example is intended to illustrate a particular embodiment of the invention, and is not intended to limit the scope of the invention.

EXAMPLE

The following procedure may be used to make a high pressure cylinder.

1. Inspect materials, the microalloy bar stock should be straight within ⅛ inch (0.32 cm) over 60 inches (152 cm). The tool steel will be a solid bar or tube with a straight and constant outside diameter. The tool steel should be in the annealed or normalized condition.

2. The finish of the tool steel bar should be constant within +/−0.001 inch (0.0025 cm). If not received in this condition it should be ground.

3. Bore a hole in the microalloy steel bar and finish so that there is a 0.005–0.006 inch (0.013–0.015 cm) interference fit for 6 times the diameter. The remaining portion of the liner can have a 0.000–0.001 inch (0.000–0.002 cm) interference fit.

4. Heat the casing to 600° F. (315° C.) and insert the tool steel into the casing. This process is preferably done while both the casing and liner are in the vertical position. The liner can be cooled with dry ice or nitrogen.

5. Bore the liner assembly to within 0.025 inch (0.064 cm) of the finished diameter.

6. Prepare the liner assembly for heat treatment by covering the ends with steel end caps and tack welding them in place.

7. Place the liner assembly into a furnace that is maintained at 2,280° F. (1,250° C.). Rotate the liner assembly slowly, so that dimensions of the cylinder do not change on heating.

8. Pull or push the liner assembly from the furnace when the outside temperature of the cylinder reaches 2,165° F. (1,185° C.). This enables the internal temperature of the tool steel to reach the critical high heat temperature.

9. Cool the cylinder on spinner rolls at high rpm. Water quench on the microalloy backing material until the outside wall temperature is maintained at 900° F. (483° C.). This has an effect similar to marquenching. The resulting tool steel hardness is typically HRC60-HRC65.

10. When the cylinder reaches 900° F. (483° C.) on the spinner rolls, remove the cylinder and cool slowly on cooling rolls to ensure that the barrel maintains straightness.

11. Finish the barrel as required.

The present manufacturing process reduces time and effort required to complete the tool steel cylinder assembly while avoiding the performance problems associated with the fabrication and use of a segmented steel liner construction.

Whereas specific embodiments of the present invention have been described herein for the purposes of illustration, it will be evident to those skilled in the art that numerous variations of the details of the invention may be made without departing from the scope of the invention as set forth in the following claims.

What is claimed is:

1. A method of lining a backing steel cylinder of a high pressure cylinder, the method comprising:

inserting an annealed tool steel liner material in the form of a bar or tube into the backing steel cylinder, wherein the bar or tube has a length that is substantially coextensive with a length of the backing steel cylinder; and heat treating the tool steel liner material and backing steel cylinder to harden the tool steel liner material by forming martensite.

2. The method of claim 1, wherein the tool steel liner material comprises high-speed tool steel, hot-worked tool steel, high carbon cold-worked tool steel, air-hardening cold-worked tool steel, oil-hardening tool steel, shock-resisting tool steel and/or water-hardening tool steel.

3. The method of claim 1, wherein the tool steel liner material comprises at least one tool steel selected from AISI A11, AISI D2, 20CV consisting essentially of 1.9 weight percent C, 0.3 weight percent Mn, 0.3 weight percent Si, 20 weight percent Cr, 1 weight percent Mo, 0.6 weight percent W, 4 weight percent V and the balance Fe, and CSM420 consisting essentially of 0.15 weight percent max C, 1 weight percent Mn, 1 weight percent Si, 12–14 weight percent Cr, 0.04 weight percent P. 0.03 weight percent S and the balance Fe.

4. The method of claim 1, wherein the tool steel liner material comprises AISI A11 tool steel.

5. The method of claim 1, wherein the backing steel cylinder comprises microalloy steel, high strength low allow steel, low carbon steel and/or austenitic stainless steel.

6. The method of claim 1, wherein the backing steel cylinder comprises microalloy steel.

7. The method of claim 1, wherein the backing steel cylinder comprises AISI 316 stainless steel.

8. The method of claim 1, wherein the tool steel liner material is inserted into the backing steel cylinder as a solid bar.

9. The method of claim 8, wherein the solid bar has a circular cross section.

10. The method of claim 8, further comprising machining a bore in the solid bar.

11. The method of claim 10, wherein the backing steel cylinder is heated to an elevated temperature of at least 300° C. before the solid bar is inserted.

12. The method of claim 1, wherein the tool steel liner material is inserted into the backing steel as a tube.

13. The method of claim 12, wherein the tube has a wall thickness of from about 3 to about 30 mm.

14. The method of claim 12, wherein the tube has a wall thickness of from about 5 to about 10 mm.

15. The method of claim 12, wherein the tube has a wall thickness of about 6 mm.

16. The method of claim 1, wherein the backing steel cylinder has a wall thickness of at least 20 mm.

17. The method of claim 1, wherein the backing steel cylinder has a wall thickness of from about 25 to about 100 mm.

18. The method of claim 1, wherein the backing steel cylinder has a wall thickness of about 50 mm.

19. The method of claim 1, wherein the backing steel cylinder has an inner diameter of from about 15 to about 380 mm.

20. The method of claim 1, wherein the backing steel cylinder has an inner diameter of from about 20 to about 90 mm.

21. The method of claim 1, wherein the tool steel liner material has an outer diameter of from about 12 to about 380 m.

22. The method of claim 1, wherein the tool steel liner material has an outer diameter of from about 18 to about 90 mm.

23. The method of claim 1, wherein the tool steel liner material has an outer diameter that is greater than or equal to an inner diameter of the backing steel cylinder when the tool steel liner material is inserted into the backing steel cylinder.

24. The method of claim 1, wherein the tool steel liner material has an outer diameter that is from about 0.05 to about 0.2 percent greater than an inner diameter of the backing steel cylinder when the tool steel liner material is inserted into the backing steel cylinder.

25. The method of claim 1, wherein the tool steel liner material has an outer diameter that is within 0.1 percent of an inner diameter of the backing steel cylinder when the tool steel liner material is inserted into the backing steel cylinder.

26. The method of claim 1, wherein the tool steel liner material and backing steel cylinder have lengths of from about 0.25 to about 8 m.

27. The method of claim 1, wherein the tool steel liner material and the backing steel cylinder have lengths of from about 0.6 to about 2 m.

28. The method of claim 1, wherein the backing steel cylinder is heated to an elevated temperature before the tool steel liner material is inserted.

29. The method of claim 28, wherein the elevated temperature is from about 300 to about 550° C.

30. The method of claim 28, wherein the elevated temperature is from about 300 to about 350° C.

31. The method of claim 1, wherein the heat treating step is performed at a temperature above about 1,000° C.

32. The method of claim 1, wherein the heat treating step is performed at a temperature of from about 1,180 to about 1,250° C.

33. The method of claim 1, wherein the backing steel cylinder and tool steel liner material are rotated around a longitudinal axis of the cylinder during the heat treating step.

34. The method of claim 1, further comprising quenching the backing steel cylinder after the heat treating step.

35. The method of claim 34, wherein the backing steel cylinder is quenched by applying liquid on the outside of the backing steel cylinder.

36. The method of claim 35, wherein liquid is applied until the outside of the backing steel cylinder is reduced to a temperature below about 480° C.

37. The method of claim 35, wherein the quenching liquid is water and is applied by spraying.

38. The method of claim 34, wherein the backing steel cylinder and tool steel liner material are rotated around a longitudinal axis of the cylinder during the quenching step.

39. The method of claim 34, further comprising air cooling the backing steel cylinder after the quenching step.

40. A method of lining a backing cylinder of a high pressure cylinder, the method comprising:

inserting an annealed tool steel liner material in the form of a bar or tube into the backing steel cylinder, wherein the bar or tube has a length that is substantially coextensive with a length of the backing steel cylinder; and heat treating the tool steel liner and backing steel cylinder, wherein the tool steel liner comprises at least one tool steel selected from AISI A11, AISI D2, 20 CV consisting essentially of 1.9 weight percent C, 0.3 weight percent Mn, 0.3 weight percent Si, 20 weight percent Cr, 1 weight percent Mo, 0.6 weight percent W, 4 weight percent V and the balance Fe, and CSM420 consisting essentially of 0.15 weight percent max C, 1 weight percent Mn, 1 weight percent Si, 12–14 weight percent Cr, 0.04 weight percent P, 0.03 weight percent S and the balance Fe.

41. A method of lining a backing cylinder of a high pressure cylinder, the method comprising:

inserting an annealed tool steel liner material in the form of a bar or tube into the backing steel cylinder, wherein the bar or tube has a length that is substantially coextensive with a length of the backing steel cylinder; and heat treating the tool steel liner and backing steel cylinder, wherein the tool steel liner comprises AISI A11 tool steel.

42. A method of lining a backing under of a high pressure cylinder, the method comprising:

inserting an annealed tool steel liner material in the form of a bar or tube into the backing steel cylinder, wherein the bar or tube has a length that is substantially coextensive with a length of the backing steel cylinder; and heat treating the tool steel liner and backing steel cylinder, wherein the backing steel cylinder comprises microalloy steel.

43. A method of lining a backing cylinder of a high pressure cylinder, the method comprising:

inserting an annealed tool steel liner material in the form of a bar or tube into the backing steel cylinder, wherein the bar or tube has a length that is substantially coextensive with a length of the backing steel cylinder; and heat treating the tool steel liner and backing steel cylinder, wherein the backing steel cylinder comprises AISI 316 stainless steel.

44. A method of lining a backing cylinder of a high pressure cylinder, the method comprising:

inserting an annealed tool steel liner material in the form of a bar or tube into the backing steel cylinder, wherein the bar or tube has a length that is substantially coextensive with a length of the backing steel cylinder; and heat treating the tool steel liner and backing steel cylinder, wherein the backing steel cylinder is heated to an elevated temperature of from about 300 to about 550° C. before the tool steel liner is inserted.

45. A method of lining a backing cylinder of a high pressure cylinder, the method comprising:

inserting an annealed tool steel liner material in the form of a bar or tube into the backing steel cylinder, wherein the bar or tube has a length that is substantially coextensive with a length of the backing steel cylinder; and heat treating the tool steel liner and backing steel cylinder, wherein the heat treating step is performed at a temperature above about 1,000° C.

46. A method of lining a backing cylinder of a high pressure cylinder, the method comprising:

inserting an annealed tool steel liner material in the form of a bar or tube into the backing steel cylinder, wherein the bar or tube has a length that is substantially coextensive with a length of the backing steel cylinder; and heat treating the tool steel liner and backing steel cylinder, wherein the backing steel cylinder and tool steel liner are rotated around a longitudinal axis of the cylinder during the heat treating.

47. A method of lining a backing cylinder of a high pressure cylinder, the method comprising:

inserting an annealed tool steel liner material in the form of a bar or tube into the backing steel cylinder, wherein the bar or tube has a length that is substantially coextensive with a length of the backing steel cylinder;

heat treating the tool steel liner and backing steel cylinder; and quenching the backing steel cylinder after the heat treating step.

* * * * *

UNITED STATES PATENT AND TRADEMARK OFFICE

CERTIFICATE OF CORRECTION

PATENT NO. : 6,887,322 B2
APPLICATION NO. : 10/119057
DATED : May 3, 2005
INVENTOR(S) : Donald W. Smith and Calvin D. Lundeen It is certified that error appears in the above-identified patent and that said Letters Patent is hereby corrected as shown below:

Column 8, Line 64 (Claim 21)
"380 m" should read --380 mm--

Column 10, Line 10 (Claim 42)
Delete "under" and insert --cylinder--

Signed and Sealed this

Fifteenth Day of August, 2006

JON W. DUDAS
*Director of the United States Patent and Trademark Office*